US009351628B2

(12) United States Patent
Erozkan et al.

(10) Patent No.: US 9,351,628 B2
(45) Date of Patent: May 31, 2016

(54) DISHWASHER COMPRISING A FAN RECEPTACLE

(71) Applicant: Arcelik Anonim Sirketi, Istanbul (TR)

(72) Inventors: Gonca Erozkan, Istanbul (TR); Orhan Atabey, Istanbul (TR)

(73) Assignee: Arcelik A.S., Istanbul (TR)

( * ) Notice: Subject to any disclaimer, the term of this patent is extended or adjusted under 35 U.S.C. 154(b) by 155 days.

(21) Appl. No.: 14/370,037

(22) PCT Filed: Dec. 27, 2012

(86) PCT No.: PCT/EP2012/076989
§ 371 (c)(1),
(2) Date: Jun. 30, 2014

(87) PCT Pub. No.: WO2013/098352
PCT Pub. Date: Jul. 4, 2013

(65) Prior Publication Data

US 2014/0360042 A1 Dec. 11, 2014

(30) Foreign Application Priority Data

Dec. 30, 2011 (TR) ..... a 2011 13322

(51) Int. Cl.
*F26B 21/06* (2006.01)
*A47L 15/48* (2006.01)
*F26B 21/00* (2006.01)

(52) U.S. Cl.
CPC ..... *A47L 15/486* (2013.01); *A47L 15/48* (2013.01); *F26B 21/004* (2013.01)

(58) Field of Classification Search
CPC ..... F26B 5/00; F26B 9/00; F26B 21/00; F26B 21/06; A47L 15/00; A47L 15/48; A47L 15/15; A47L 15/486; B08B 3/00
USPC ..... 34/202, 210, 218; 134/56 D, 58 D, 95.3
See application file for complete search history.

(56) References Cited

U.S. PATENT DOCUMENTS 7,228,647 B2 * 6/2007 Hong ..... D06F 58/24 34/596
8,469,043 B2 * 6/2013 Tolf ..... 134/102.3

(Continued)

FOREIGN PATENT DOCUMENTS

EP 2797479 A1 * 11/2014 ..... A47L 15/486
WO WO 2010091159 A2 * 8/2010 ..... A47L 15/0034
WO WO 2013098352 A1 * 7/2013 ..... A47L 15/486

*Primary Examiner* — Stephen M Gravini
(74) *Attorney, Agent, or Firm* — Venjuris P.C.

(57) ABSTRACT

The present invention relates to a dishwasher (1) comprising a tub (2) wherein the items to be washed are placed, a body (4) having two side walls (3) that surround the tub (2), a fan receptacle (5) located between the tub (2) and the side wall (3), an air channel (8) located in the fan receptacle (5), having an inlet (6) that provides the humid air in the tub (2) to be received therein and an outlet (7) that provides the dehumidified air to be sent back to the tub (2), a fan (9) located in the fan receptacle (5), providing the humid air in the tub (2) to be sucked during the drying step, a hole (10) arranged on the fan receptacle (5), that allows the air received from the outer environment to enter into the air channel (8) and a guiding member (11).

16 Claims, 3 Drawing Sheets

(56) References Cited

Figure 1:
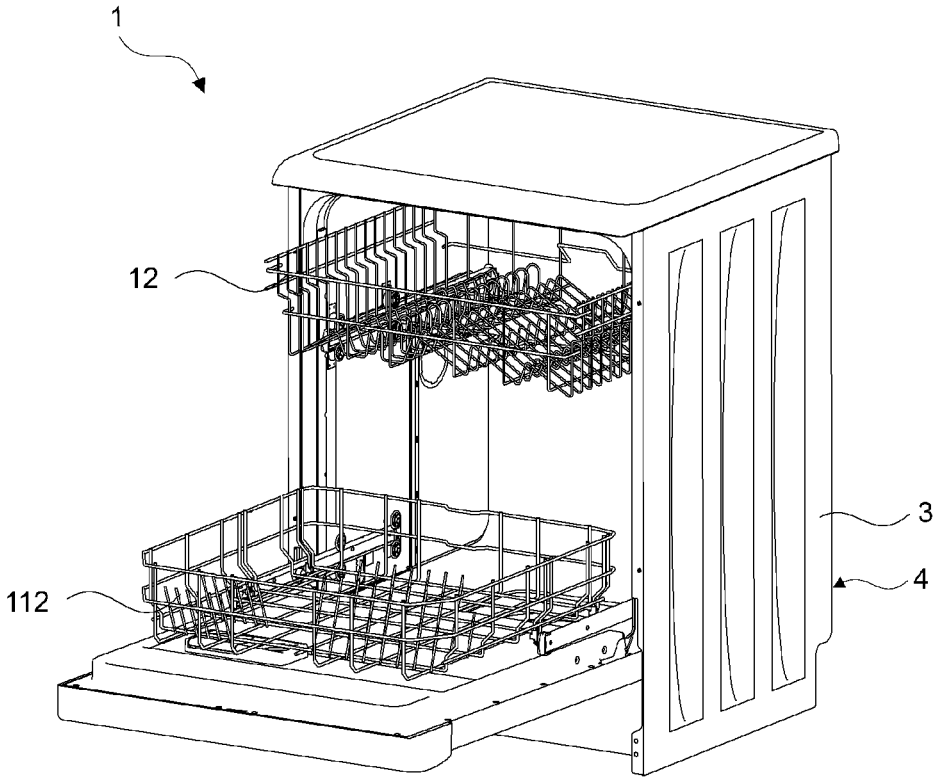

U.S. PATENT DOCUMENTS 8,696,824 B2 * 4/2014 Jadhav ..... A47L 15/0034 134/19
9,101,255 B2 * 8/2015 Ak ..... A47L 15/4217
2014/0360042 A1 * 12/2014 Erozkan ..... A47L 15/486 34/218
2015/0059198 A1 * 3/2015 Park ..... A47L 15/481 34/80
2015/0122299 A1 * 5/2015 Aras ..... A47L 15/16 134/56 D
2015/0257625 A1 * 9/2015 Basesme ..... A47L 15/4272 312/228
2015/0335224 A1 * 11/2015 Gursoy ..... A47L 15/4418 134/99.2
2015/0342441 A1 * 12/2015 Hahm ..... A47L 15/4291 34/79

* cited by examiner

DISHWASHER COMPRISING A FAN RECEPTACLE

The present invention relates to a dishwasher comprising a fan receptacle located on the body.

In dishwasher programs, the drying step is started after the washing and rinsing steps. In the drying step, it is aimed to remove the water remaining on the dishes and also to prevent the moisture in the tub from leaving stains on the dishes getting cold after the rinsing step by condensing. The last rinsing step is performed with hot water in order to remove the water remaining on the dishes in an easier way in the drying step. This requires a great amount of energy to be consumed for heating the water. In the drying step after the hot rinsing step, humid air in the tub is passed through an air channel situated next to the tub. When the air circulated through the air channel by means of a fan contacts the surfaces of the air channel that are colder than the inside of the tub, some of the moisture in the air is condensed. However, the moisture in the tub cannot be completely removed and stain formation is observed on the washed items due to the remaining moisture at the end of the drying step.

In the state of the art Korean Patent Document No. KR20050014516, it is explained that the drying performance of the dishwasher is improved as a result of the condensing that occurs with the mixing of the hot air drawn into the air channel from the inside of the tub and the cold air received from the outer environment.

The aim of the present invention is the realization of a dishwasher wherein the moisture that remains in the tub at the end of the washing process is effectively removed.

The dishwasher realized in order to attain the aim of the present invention, explicated in the first claim and the respective claims thereof, comprises a body having two side walls, a fan receptacle and an air channel integrated with the fan receptacle. Having an outlet that provides the entry of air into the tub and an inlet that provides the exit of the air in the tub to the outside, the air channel provides a closed air cycle between the outlet and the inlet. The circulation of the vapor in the tub, sucked into the air channel during the drying step is realized by means of the fan. On the fan receptacle, a hole is arranged, that allows the air received from the outer environment to enter into the air channel.

In the dishwasher of the present invention, there is a guiding member that extends between the outer environment air and the humid air drawn from the tub, thus that provides these two airs with different moisture ratios to flow through the air channel for a period of time without mixing with each other.

In an embodiment of the present invention, the hole and the guiding member are located in the air channel, at a higher position with respect to the inlet and the outlet. The vapor drawn from the inside of the tub is at a higher temperature with respect to the air inside the air channel. For this reason, the vapor tends to rise in the air channel. By the guiding member being at the higher portion of the air channel, the vapor is provided to hit the guiding member and to leave its moisture on the guiding member.

In an embodiment of the present invention, the humid air received from the tub into the air channel is drawn from the level of the upper rack. In this embodiment, the hole is located at a higher position than the upper rack.

In a derivative of this embodiment, the dehumidified air is sent from the air channel to the tub through between the upper rack and the lower rack. Thus, items placed on both racks are provided to be equally dried.

In an embodiment of the present invention, the outer environment air and the humid air flow separately through the air channel for a period of time, then mix with each other in the air mixing cell. In this embodiment, the air mixing in the air mixing cell leaves its moisture in the air channel and is guided into the tub by means of the outlet.

In an embodiment of the present invention, one part of the guiding member extends on the horizontal plane and the other part on the vertical plane. With the guiding member extending on both planes, the humid air is provided to leave its moisture in a more effective manner.

In a derivative of this embodiment, the guiding member is in form of a horizontally-tilted L. The hot air coming from the inside of the tub rises in the air channel and hits the guiding member, thus providing an efficient condensation.

In an embodiment of the present invention, there are barriers extending in the air channel. By means of the barriers, the path followed by the humid air in the air channel is prolonged.

In an embodiment of the present invention, the dry air in the air channel is blown directly over the lower part of the cutlery basket. Thus, stain formation on items such as fork, spoon, knife, generally produced from metal is prevented.

In the dishwasher of the present invention, during the drying step the humid air in the tub is mixed with the air received from the outer environment in the air mixing cell. The air mixing cell being at the beginning of the air channel provides the humid air to condensate in an efficient manner. In cases the second rinsing temperature is low, an efficient drying is obtained, thus providing energy saving.

The model embodiments relating to the dishwasher realized in order to attain the aim of the present invention are illustrated in the attached figures, where:

FIG. 1—is the perspective view of a dishwasher.

Figure 2:
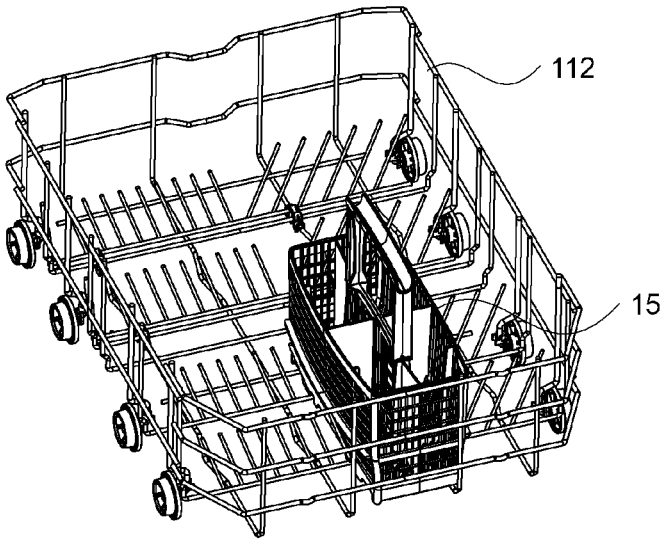

FIG. 2—is the perspective view of a lower rack and a cutlery basket in an embodiment of the present invention.

Figure 3:
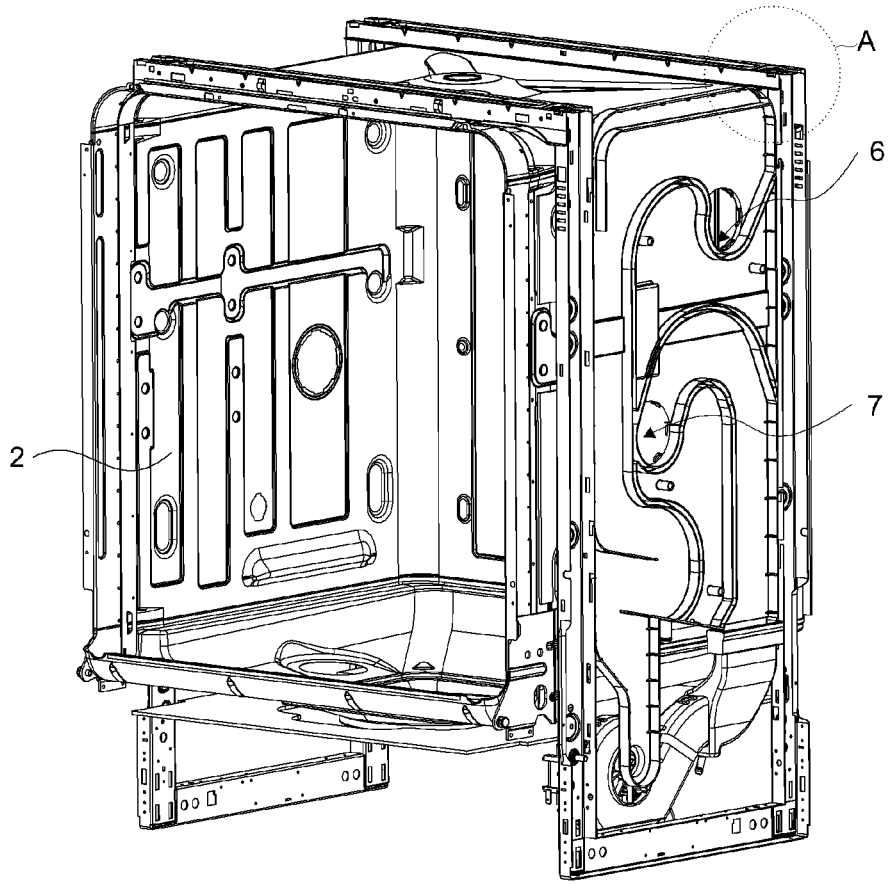

FIG. 3—is the perspective view of the tub and the fan receptacle.

Figure 4:
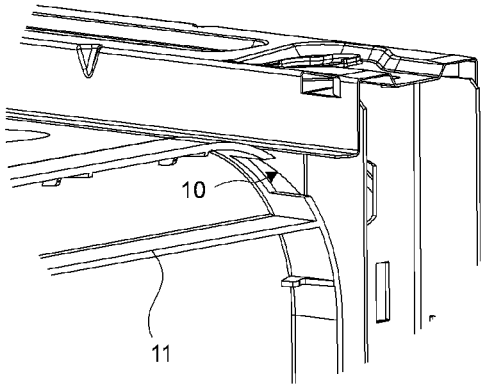

FIG. 4—is the view of detail A in FIG. 3.

Figure 5:
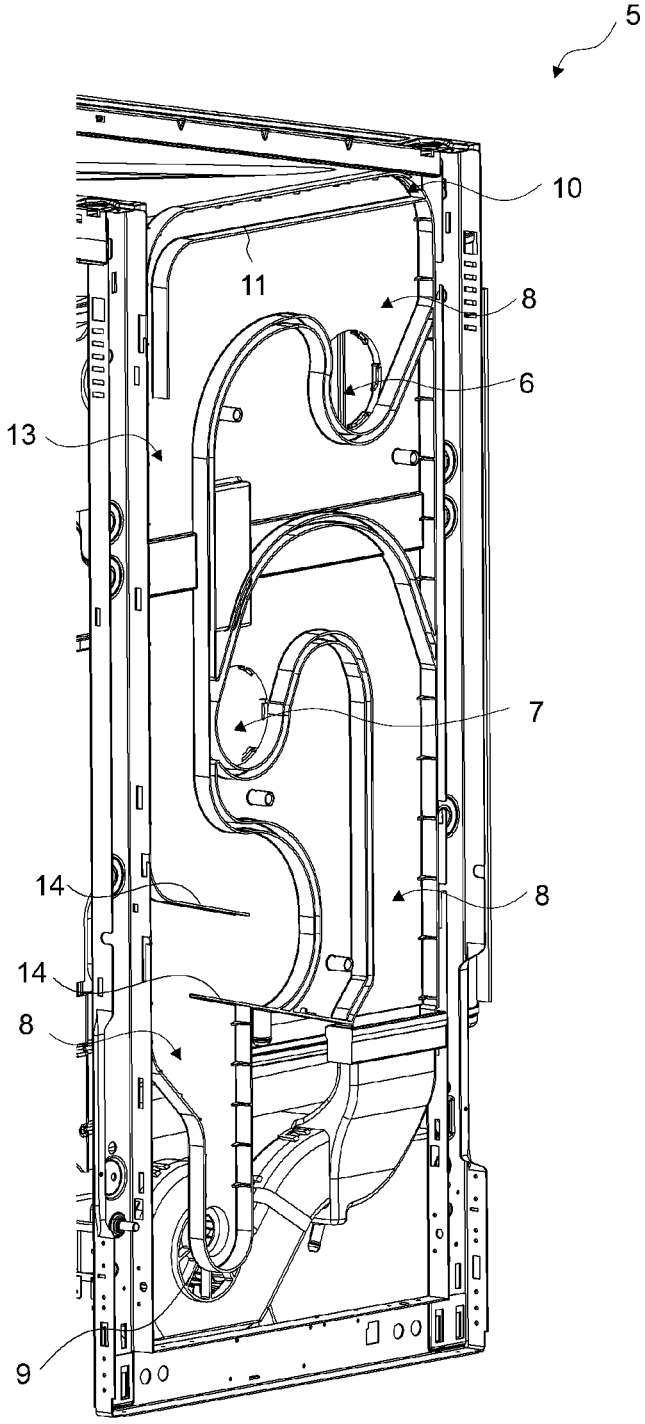

FIG. 5—is the partial perspective view of a fan receptacle in an embodiment of the present invention.

The elements illustrated in the figures are numbered as follows:

1. Dishwasher
2. Tub
3. Side wall
4. Body
5. Fan receptacle
6. Inlet
7. Outlet
8. Air channel
9. Fan
10. Hole
11. Guiding member
12. , 112 Rack
13. Air mixing cell
14. Barrier
15. Cutlery basket The dishwasher (1) comprises a tub (2) wherein the items to be washed are placed, a body (4) having two side walls (3) that surround the tub (2), a fan receptacle (5) located between the tub (2) and the side wall (3), an air channel (8) located in the fan receptacle (5), having an inlet (6) that provides the humid air in the tub (2) to be received therein and an outlet (7) that provides the dehumidified air to be sent back to the tub (2), a fan (9) located in the fan receptacle (5), providing the humid air in the tub (2) to be sucked during the drying step and a hole (10) arranged on the fan receptacle (5), that allows the air received from the outer environment to enter into the air channel (8).

The dishwasher (1) of the present invention comprises a guiding member (11) that is located in the air channel (8), between the inlet (6) and the hole (10) and that forms a wall between the humid air entering the air channel (8) through the inlet (6) and the outer environment air entering into the air channel (8) through the hole (10), thus enabling them to flow a portion of the distance they cover in the air channel (8) without mixing with each other.

As a result of the evaporation of the water in the tub (2) due to the high temperature during the operation of the dishwasher (1), high relative humidity values are reached in the tub (2) at the beginning of the drying step. As the drying step is started, the humid air inside the tub (2) is received into the air channel (8) by means of the fan (9). The humid air drawn from the inlet (6) mixes with the outer environment air received from the hole (10) and thus the humid air is provided to mix with the dry air. In the dishwasher (1) of the present invention, there is a guiding member (11) in the air channel (8). Extending between the air drawn from the outer environment and the air drawn from the tub (2), the guiding member (11) provides the humid air and the dry air to flow through the air channel (8) for a period of time without mixing with each other. The humid air and the dry air separately moving through the air channel (8) along the guiding member (11) mix with each other at the end of the guiding member (11). The air distance between the inlet (6) and the outlet (7) is different from the distance the air inside the air channel (8) covers between the inlet (6) and the outlet (7). Thus, the air is enabled to remain in the air channel (8) for a longer period of time, thus to be efficiently dehumidified.

In an embodiment of the present invention, the dishwasher (1) comprises the hole (10) and the guiding member (11) that are positioned so as to be close to the ceiling of the body (4). Thus, the distance the air inside the air channel (8) covers is prolonged.

In an embodiment of the present invention, the dishwasher (1) comprises a lower rack (12) and an upper rack (112) wherein the items to be washed are placed, the inlet (6) that is positioned so as to enable the humid air coming from the tub (2) to enter the air channel (8) at the level of the upper rack (112) and the hole (10) positioned at a higher level than the inlet (6). In this embodiment, by means of the form of the guiding member (11), the outer environment air coming from the hole (10) moves from top to bottom until it meets the humid air sucked from the tub (2). After mixing with the air coming from inlet (6) that is at the same level with the upper rack (112), the outer environment air continues its movement from top to bottom until the position of the fan (9). After the position of the fan (9), the outer environment air moves from bottom to top until the outlet (7).

In a derivative of this embodiment, the dishwasher (1) comprises the outlet (7) that is positioned so as to enable air to be sent between the racks (12, 112). Thus, the dehumidified air is blown towards both racks (12, 112) from approximately equal distances and the drying is provided to be realized in a homogeneous manner.

In an embodiment of the present invention, the dishwasher (1) comprises an air mixing cell (13) that is located in the air flow direction after the guiding member (11) and wherein the outer environment air and the humid air flowing without mixing with each other by being separated by means of the guiding member (11) are mixed, and the air channel (8) that provides the mix formed in the air mixing cell (13) to flow therethrough to enter the tub (2). In this embodiment, the air mixing cell (13) is at a position between the inlet (6) and the outlet (7), closer to the inlet (6). Thus, the mixed air leaves its moisture in the air channel (8) until it reaches the outlet (7) from the air mixing cell (13).

In an embodiment of the present invention, the guiding member (11) enables the air moving through the air channel (8) to flow first in the horizontal direction, then in the vertical direction. Thus, the outer environment air and the humid air are prevented from mixing with each other in the air channel (8) for a period of time.

In a derivative of this embodiment, the guiding member (11) is in form of a horizontally-tilted L. With the guiding member (11) extending both on the horizontal and vertical planes, the humid air is more efficiently dehumidified.

In an embodiment of the present invention, the air channel (8) comprises at least one barrier (14) that prolongs the distance the air flowing therein covers and provides the said air to leave more of its moisture. Thus, the humid air contacts more surfaces in the air channel (8) and its condensation efficiency is increased.

In an embodiment of the present invention, the dishwasher (1) comprises a cutlery basket (15) wherein small-sized items are placed and the outlet (7) that is positioned so as to direct the dehumidified air coming from the air channel (8) towards over the lower part of the cutlery basket (15). With the dehumidified air being directed towards over the cutlery basket (15), metal items in the cutlery basket (15) transmits the heat it is subjected to into the tub (2) and an efficient drying performance is provided.

By means of the present invention, in the drying step, the moisture of the air in the tub (2) is decreased. Thus, the drying performance of the dishwasher (1) is improved, the drying time is decreased and energy saving is provided.

It is to be understood that the present invention is not limited to the embodiments disclosed above and a person skilled in the art can easily introduce different embodiments. These should be considered within the scope of the protection postulated by the claims of the present invention.

The invention claimed is:

1. A dishwasher (1) comprising a tub (2) wherein the items to be washed are placed, a body (4) having two side walls (3) that surround the tub (2), a fan receptacle (5) located between the tub (2) and the side wall (3), an air channel (8) located in the fan receptacle (5), having an inlet (6) that provides the humid air in the tub (2) to be received therein and an outlet (7) that provides the dehumidified air to be sent back to the tub (2), a fan (9) located in the fan receptacle (5), providing the humid air in the tub (2) to be sucked during the drying step and a hole (10) arranged on the fan receptacle (5), that allows the air received from the outer environment to enter into the air channel (8), characterized by a guiding member (11) that is located in the air channel (8), between the inlet (6) and the hole (10) and that forms a wall between the humid air entering the air channel (8) through the inlet (6) and the outer environment air entering into the air channel (8) through the hole (10), thus enabling them to flow a portion of the distance they cover in the air channel (8) without mixing with each other.

2. A dishwasher (1) as in claim 1, characterized by the hole (10) and the guiding member (11) that are positioned so as to be close to the ceiling of the body (4).

3. A dishwasher (1) as in claim 2, characterized by a lower rack (12) and an upper rack (112) wherein the items to be washed are placed, the inlet (6) that is positioned so as to enable the humid air coming from the tub (2) to enter the air channel (8) at the level of the upper rack (112) and the hole (10) positioned at a higher level than the inlet (6).

4. A dishwasher (1) as in claim 3, characterized by the outlet (7) that is positioned so as to provide air to be sent between the racks (12, 112).

5. A dishwasher (1) as in claim 4, characterized by an air mixing cell (13) that is located in the air flow direction after the guiding member (11) and wherein the outer environment air and the humid air flowing without mixing with each other by being separated by means of the guiding member (11) are mixed, and the air channel (8) that provides the mix formed in the air mixing cell (13) to flow therethrough to enter the tub (2).

6. A dishwasher (1) as in claim 5, characterized by the guiding member (11) that enables the air moving through the air channel (8) to flow first in the horizontal direction, then in the vertical direction.

7. A dishwasher (1) as in claim 6, characterized by the guiding member (11) in form of a horizontally tilted L.

8. A dishwasher (1) as in claim 7, characterized by the air channel (8) comprising at least one barrier (14) that prolongs the distance the air flowing therein covers, thus providing it to leave more of its moisture.

9. A dishwasher (1) as in claim 8, characterized by a cutlery basket (15) wherein small-sized items are placed and the outlet (7) that is positioned so as to direct the dehumidified air coming from the air channel (8) towards over the lower part of the cutlery basket (15).

10. A dishwasher (1) as in claim 1, characterized by a lower rack (12) and an upper rack (112) wherein the items to be washed are placed, the inlet (6) that is positioned so as to enable the humid air coming from the tub (2) to enter the air channel (8) at the level of the upper rack (112) and the hole (10) positioned at a higher level than the inlet (6).

11. A dishwasher (1) as in claim 10, characterized by the outlet (7) that is positioned so as to provide air to be sent between the racks (12, 112).

12. A dishwasher (1) as in claim 1, characterized by an air mixing cell (13) that is located in the air flow direction after the guiding member (11) and wherein the outer environment air and the humid air flowing without mixing with each other by being separated by means of the guiding member (11) are mixed, and the air channel (8) that provides the mix formed in the air mixing cell (13) to flow therethrough to enter the tub (2).

13. A dishwasher (1) as in claim 1, characterized by the guiding member (11) that enables the air moving through the air channel (8) to flow first in the horizontal direction, then in the vertical direction.

14. A dishwasher (1) as in claim 1, characterized by the guiding member (11) in form of a horizontally tilted L.

15. A dishwasher (1) as in claim 1, characterized by the air channel (8) comprising at least one barrier (14) that prolongs the distance the air flowing therein covers, thus providing it to leave more of its moisture.

16. A dishwasher (1) as in claim 1, characterized by a cutlery basket (15) wherein small-sized items are placed and the outlet (7) that is positioned so as to direct the dehumidified air coming from the air channel (8) towards over the lower part of the cutlery basket (15).

* * * * *